US005934950A

United States Patent [19]

Yeow

[11] Patent Number: 5,934,950

[45] Date of Patent: Aug. 10, 1999

[54] ELECTRICAL CONTACT WITH MULTIPLE POINTS OF CONTACT

[75] Inventor: Yew Thye Yeow, Canton, Mich.

[73] Assignee: Ford Motor Company, Dearborn, Mich.

[21] Appl. No.: 08/993,515

[22] Filed: Dec. 18, 1997

[51] Int. Cl.[6] ..... H01R 11/22

[52] U.S. Cl. ..... 439/852; 439/861

[58] Field of Search ..... 439/839, 842, 439/816, 851, 852, 854, 856, 857, 858, 860, 861, 862, 863, 864, 251, 252

[56] References Cited

U.S. PATENT DOCUMENTS

| | | | |
|---|---|---|---|
| 3,622,956 | 11/1971 | Zak . | |
| 4,012,106 | 3/1977 | Filson . | |
| 4,545,638 | 10/1985 | Neidich . | |
| 5,411,419 | 5/1995 | Ochi . | |
| 5,611,717 | 3/1997 | Joly | 439/857 |
| 5,749,755 | 5/1998 | Genta et al. | 439/856 |
| 5,785,560 | 7/1998 | Akamatsu | 439/851 |

FOREIGN PATENT DOCUMENTS

| | | |
|---|---|---|
| 377930 | 7/1973 | U.S.S.R. . |
| 864394 | 9/1981 | U.S.S.R. . |
| PCT/US89/04889 | 11/1989 | WIPO . |

*Primary Examiner*—Lincoln Donovan
*Attorney, Agent, or Firm*—Mark Mollon

[57] ABSTRACT

An electrical contact includes a lead-in barrel section enclosing a pin receiving cavity having a generally longitudinally uniform cross section extending a predetermined length and an electrically conducting rib cage portion adjacent to and extending from the barrel section having a spinal portion with a plurality of curved cantilevered tynes projecting symmetrically therefrom, attached at one end to the spinal portion, and spaced apart at the other end from a corresponding tyne, each tyne extending a predetermined longitudinal length substantially less than the lead-in barrel section predetermined length.

9 Claims, 1 Drawing Sheet

ELECTRICAL CONTACT WITH MULTIPLE POINTS OF CONTACT

FIELD OF THE INVENTION

The present invention relates to electrical contacts, and more specifically, to contacts with multiple points of contact.

BACKGROUND OF THE INVENTION

Failures of conventional separable electrical contacts can be classified as both short and long term. Two short term failure modes are contact stubbing and over stressing of the contact tynes. Stubbing occurs when the insertion force of the male portion coupled with misalignment of the male portion upon insertion into the female portion damages one or more of the tynes as well as the lead-in section of the female portion. Over stressing results in substantial reduction in contact normal force. The reduction in contact force causes high contact resistance which can lead to over heating and burnt contacts when the current level is high.

Two long term failure modes are stress relaxation of the contact tynes and fretting. The relaxation of the contacts can be mitigated by providing additional mechanical assist or lowering the stress levels in the contact tynes. However, due to packaging and contact physics requirements, it is very difficult to eliminate relaxation of the contacts altogether. Fretting is the relative micro-motion at the contact interface between male and female contact portions. There are typically three fretting failure modes. The first two modes, known as rocking and twisting, are female contact portion angular displacement relative to the longitudinal axis of the male contact portion. The third failure mode, known as sliding, is the translational motion of the contact portions relative to one another. Fretting causes the interface between the male and female contact portions to wear out. Thus causing high contact resistance which in turn exhibits the same type of failure as previously described for short term failure modes.

Electrical contact design efforts have been directed at solving the aforementioned problems. One design of an electrical contact is disclosed in U.S. Pat. No. 4,545,638 entitled Rib Cage Terminal. The female connector disclosed therein has a central spine from which extends, at first and second ends of the connector, one or more pairs of cantilevered beams. The beams in each pair are angled forwardly or rearwardly and are formed into a structure generally reminiscent of a human rib cage. The ribbed structure defines a generally enclosed opening. The connector is received in a cavity formed in a housing. The housing is utilized for structural rigidity because the disclosed "rib cage" connector is not robust enough to operate as a stand alone connector.

This design is disadvantageous because the extra step of placing the connector in a housing increases manufacturing difficulty and adds cost. Further, this operation is often done by hand and is therefore prone to human error. For example, due to the repetitive nature of the operation it is common for the operator to "miss" placing a connector in a particular housing. This housing, when used in the field, will have to be discarded.

Accordingly, a need exists in the art for an electrical connector which overcomes long and short term failure modes, is robust enough to withstand repeated use, and lacks the manufacturing difficulty, cost and error associated with previous designs.

SUMMARY OF THE INVENTION

Responsive to the deficiencies in the prior art, the present invention provides an electrical contact including a lead-in barrel section enclosing a pin receiving cavity having a generally longitudinally uniform cross section extending a predetermined length and an electrically conducting rib cage portion adjacent to and extending from the barrel section having a spinal portion with a plurality of curved cantilevered tynes projecting symmetrically therefrom, attached at one end to the spinal portion, and spaced apart at the other end from a corresponding tyne, each tyne extending a predetermined longitudinal length substantially less than the lead-in barrel section predetermined length.

According to a preferred embodiment of the present invention the electrical contact further includes a terminal barrel section extending from the rib cage portion and opposite the lead-in barrel section, having a generally longitudinally uniform cross section extending a predetermined length substantially greater than the tyne predetermined longitudinal length.

According to a feature of the present invention the lead-in barrel section is tapered so as to facilitate receiving a pin contact therethrough.

An advantage of the present invention is that the present electrical contact has a lead-in barrel section and a terminal barrel section which provides rigid support for a male contact, thereby obviating the need for a connector housing.

BRIEF DESCRIPTION OF THE DRAWINGS

Other features and advantages of the present invention will become apparent to those skilled in the electrical contact related arts upon reading the following description with reference to the accompanying drawings, in which.

DETAILED DESCRIPTION OF THE PREFERRED EMBODIMENT

Figure 1:
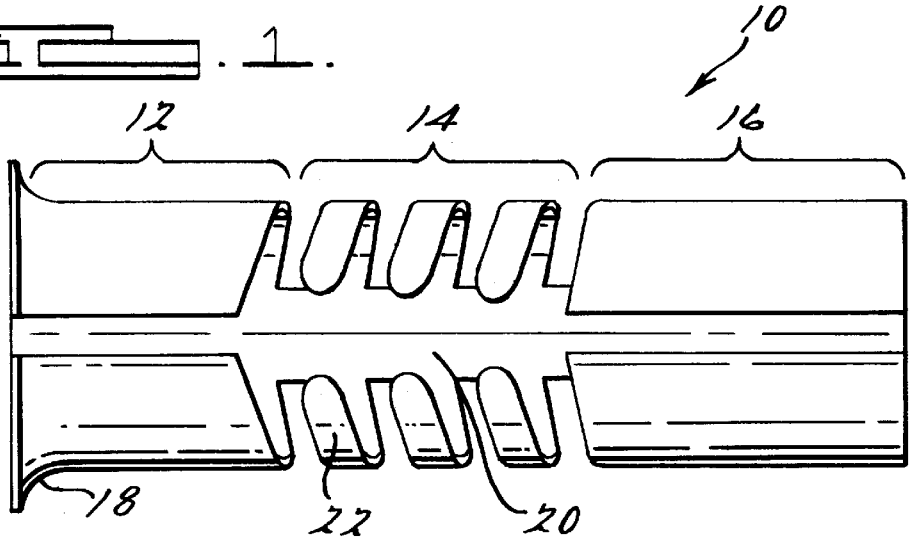
FIG. 1 is a top view of an electrical contact with tynes directed toward the lead-in section according to the present invention.
Figure 2:
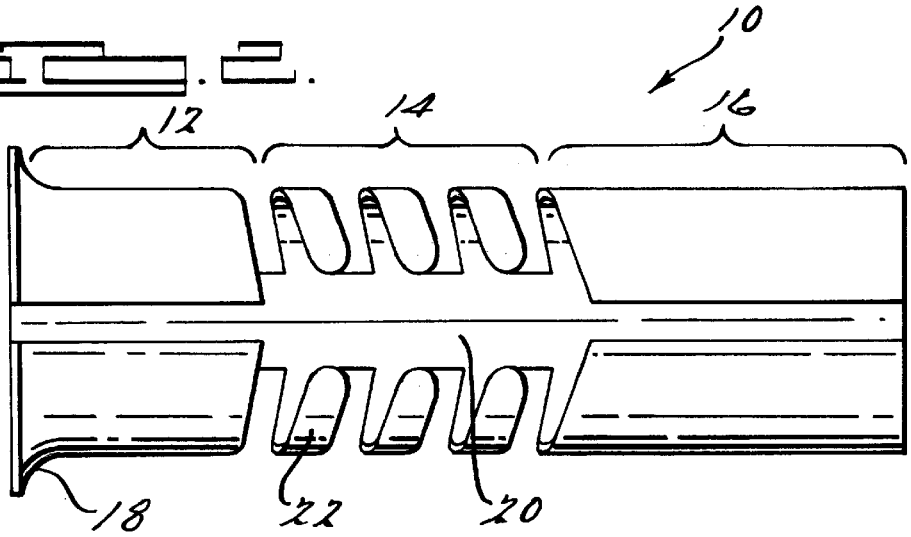
FIG. 2 is a top view of an electrical contact with tynes directed away from the lead-in section according to the present invention.
Figure 3:
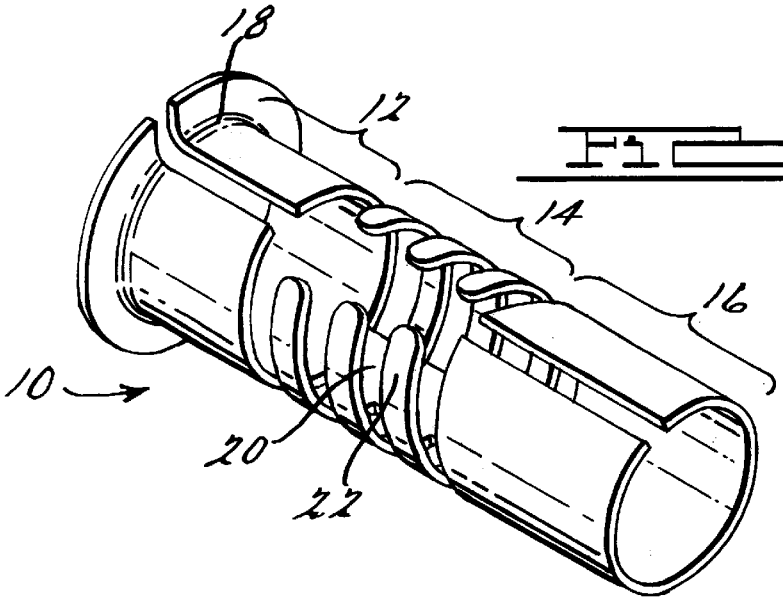
FIG. 3 is a perspective view of an electrical contact with a circular cross-section according to the present invention.

Turning now to the drawings, and in particular to FIGS. 1–3 thereof, wherein a female electrical contact 10 with a lead-in barrel section 12, a central rib cage portion 14, and a terminal barrel section 16 is shown. The structural attributes of the electrical contact 10 are made by conventional stamping and forming processes. The electrical connector 10 has preferably a uniform, pin receiving, cross-section. As shown in FIG. 3, the cross-section is therein shown as circular but may be any other suitable cross-section, such as oval or rectangular, without departing from the scope of the present invention. The electrical contact 10 is preferably formed from a copper alloy.

The lead-in barrel section 12 has a predetermined longitudinal length and a tapered end 18. The tapered end 18 advantageously guides a male contact (not shown) into the female electrical contact 10 without the male contact stubbing the perimeter of the barrel section 12. The barrel section 12 length is sufficiently long enough to insure that the longitudinal axes of both the male contact and female contact 10 are aligned when the male contact reaches the rib cage portion 14. Without the lead-in barrel section 12 the male contact longitudinal axis may be misaligned with respect to the female contact 10 longitudinal axis, thereby bringing the male contact into communication with the rib cage portion 14 from a damaging angle.

Adjacent to and projecting from the lead-in barrel section 12 is the rib cage portion 14. The rib cage portion 12 has a spinal portion 20 with a plurality of curved cantilevered tynes 22 projecting therefrom. Each tyne 22 has a predetermined longitudinal length substantially less than the predetermined length of the lead-in barrel section 12. The tynes 22 symmetrically project from the spinal portion 20 and are preferably in three opposed pairs. The tynes 22 are attached at one end to the spinal portion 20 and are independently spaced apart at the other end from a corresponding tyne 22. Further, the tynes 22 may be angled, with respect to a longitudinal axis of the spinal portion 20, toward or away from the lead-in barrel section 12 depending on particular design requirements and the attributes of the male connector. If so desired, the tynes 22 may project perpendicular to the axis of the spinal portion 20. The independent tynes 22 are advantageously sequentially loaded as the male connector is guided into the female connector 10 thereby decreasing the engagement force required. This advantage reduces the peak insertion force required and permits smooth entry of the male connector. Further, the independent tynes 22 provide multiple points of contact with the male contact thereby providing redundancies and higher current carrying capacity thus providing a more robust and reliable connection.

Adjacent to and projecting from the rib cage portion 14 and opposite the lead-in barrel section 12 is the terminal barrel section 16. The terminal barrel section 16 also has a predetermined longitudinal length. The predetermined longitudinal length of both the lead-in barrel section 12 and the terminal barrel section 16 are substantially greater than the longitudinal length of each individual tyne 22. Upon complete insertion of the male contact into the female contact 10, the male contact terminates at a location along the terminal barrel portion longitudinal length. The male contact is thus shrouded by both the lead-in barrel section 12 and the terminal barrel section 16 on either end of the rib cage portion 14. This is advantageous because the combined sectional support provides a robust and rigid relationship between the male and female contacts thereby eliminating the rocking and twisting fretting failure modes. Therefore, the herein described female electrical connector may act as a stand alone connector without having to be placed in a housing for structural support, a substantial manufacturing advantage.

Only one embodiment of an electrical connector of the present invention has been described. Those skilled in the electrical connector arts will appreciate that others may be possible without departing from the scope of the following claims.

We claim:

1. An electrical contact comprising:

a lead-in barrel section enclosing a pin receiving cavity with a longitudinal axis extending therethrough, having a generally uniform cross section longitudinally extending a first predetermined length sufficient to provide rigid retention when a male connector pin is inserted therein; and an electrically conducting rib cage portion adjacent to and extending from the lead-in barrel section, having a spinal portion with a plurality of curved cantilevered tynes projecting symmetrically therefrom and angled uniformly toward the lead-in barrel section with respect to an axis of the spinal portion, the tynes attached at one end to the spinal portion and spaced apart at the other end from an opposing tyne, each of said tynes extending a second predetermined longitudinal length less than said first predetermined length, said second predetermined longitudinal lengths of said tynes in combination being insufficient to provide rigid retention when a male connector pin is inserted therein, said tynes providing multiple points of contact with said male connector pin.

2. An electrical contact according to claim 1 further comprising a terminal barrel section extending from the rib cage portion and opposite the lead-in barrel section, having a generally uniform cross section longitudinally extending a third predetermined length substantially greater than said second predetermined longitudinal length so as to provide a substantially rigid support structure for a pin contact.

3. An electrical contact according to claim 1 wherein the lead-in barrel section is tapered so as to facilitate receiving a pin contact therethrough.

4. An electrical contact comprising:

a lead-in barrel section enclosing a pin receiving cavity with a longitudinal axis extending therethrough, having a generally uniform cross section longitudinally extending a first predetermined length sufficient to provide rigid retention when a male connector pin is inserted therein; and an electrically conducting rib cage portion adjacent to and extending from the lead-in barrel section, having a spinal portion with a plurality of curved cantilevered tynes projecting symmetrically therefrom and angled uniformly away from the lead-in barrel section with respect to an axis of the spinal portion, the tynes attached at one end to the spinal portion and spaced apart at the other end from an opposing tyne, each of said tynes extending a second predetermined longitudinal length less than said first predetermined length, said second predetermined longitudinal lengths of said tynes in combination being insufficient to provide rigid retention when a male connector pin is inserted therein, said tynes providing multiple points of contact with said male connector pin.

5. An electrical contact according to claim 4 further comprising a terminal barrel section extending from the rib cage portion and opposite the lead-in barrel section, having a generally uniform cross section longitudinally extending a third predetermined length substantially greater than said second predetermined longitudinal length so as to provide a substantially rigid support structure for a pin contact.

6. An electrical contact according to claim 4 wherein the lead-in barrel section is tapered so as to facilitate receiving a pin contact therethrough.

7. An electrical contact comprising:

a tapered lead-in barrel section enclosing a pin receiving cavity with a longitudinal axis extending therethrough, having a generally uniform cross section longitudinally extending a first predetermined length sufficient to provide rigid retention when a male connector pin is inserted therein;

a central electrically conducting rib cage portion adjacent to and extending from the lead-in barrel section, having a spinal portion with a plurality of opposed curved cantilevered tynes projecting symmetrically therefrom, the tynes attached at one end to the spinal portion and spaced apart at the other end from an opposing tyne, each of said tynes extending a second predetermined longitudinal length less than said first predetermined length, said second predetermined longitudinal lengths of said tynes in combination being insufficient to provide rigid retention when a male connector pin is inserted therein, said tynes providing multiple points of contact with said male connector pin; and a terminal barrel section extending from the rib cage portion and opposite the lead-in barrel section, having a generally uniform cross section longitudinally extending a third predetermined length greater than said second predetermined longitudinal length so as to provide a substantially rigid support structure for a pin connector.

8. An electrical contact according to claim 7 wherein the tynes are angled uniformly away from the lead-in barrel section with respect to an axis of the spinal portion.

9. An electrical contact according to claim 7 wherein the tynes are angled uniformly toward the lead-in barrel section with respect to an axis of the spinal portion.

* * * * *